United States Patent [19]

Schmeisser

[11] Patent Number: 5,060,455

[45] Date of Patent: Oct. 29, 1991

[54] ROBOTIC CASE PACKING SYSTEM AND METHOD

[75] Inventor: Heinz Schmeisser, Greenfield, Wis.

[73] Assignee: Ameco Corporation, Menomonee Falls, Wis.

[21] Appl. No.: 545,375

[22] Filed: Jun. 28, 1990

[51] Int. Cl.[5] ..... B65B 5/06

[52] U.S. Cl. ..... 53/448; 53/247; 53/251; 53/473; 53/539

[58] Field of Search ..... 53/448, 443, 473, 538, 53/537, 543, 539, 247, 252, 251, 250, 249, 261, 257, 499

[56] References Cited

U.S. PATENT DOCUMENTS

| | | | |
|---|---|---|---|
| 3,123,956 | 3/1964 | Fisher | 53/499 X |
| 3,340,677 | 9/1967 | Van Luxemborg | 53/247 |
| 4,300,330 | 11/1981 | Hartness | 53/247 X |
| 4,644,734 | 2/1987 | Hartness | 53/247 X |
| 4,918,907 | 4/1990 | Roach et al. | 53/53 X |

*Primary Examiner*—James F. Coan

*Attorney, Agent, or Firm*—Hill, Van Santen, Steadman & Simpson

[57] ABSTRACT

A robotic case packing system arranges a row of articles entering on a conveyor into an arrangement corresponding to the arrangement of articles to be packaged, where an end effector of a robotic arm engages the individual articles and lifts them for placement into waiting cases. The end effector of a first embodiment includes opposed pairs of stationary and pivoting gripper elements for engaging each of the articles. The pivoting gripper elements are provided through the action of cylinders operating through a linkage connected to a lever for rotating a cam shaft on which is mounted a cam for engaging a cam follower on the pivoting gripper element. A second embodiment includes suction cups for engaging smooth tops of articles. To ensure that the cases to be packed are square and that the flaps are open, a box squaring mechanism engages and squares the cases, while the robotic arm is controlled to use the engaged articles to push the flaps of the cases to an open position using a zig-zag motion before inserting the articles.

9 Claims, 6 Drawing Sheets

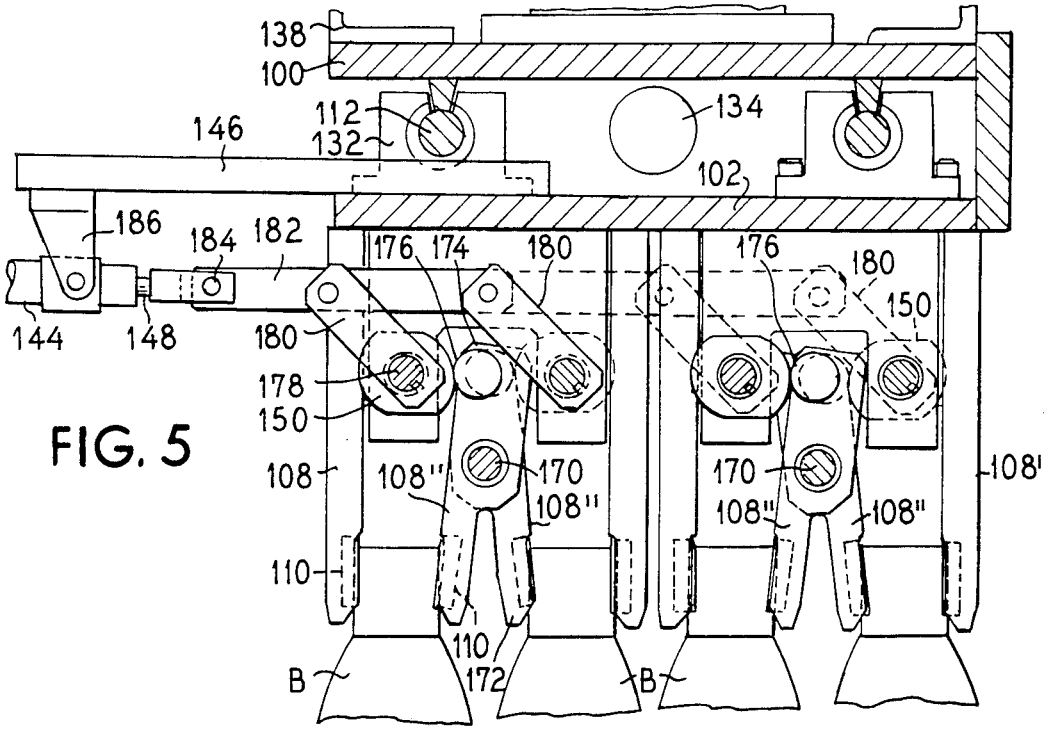
FIG. 5
FIG. 6
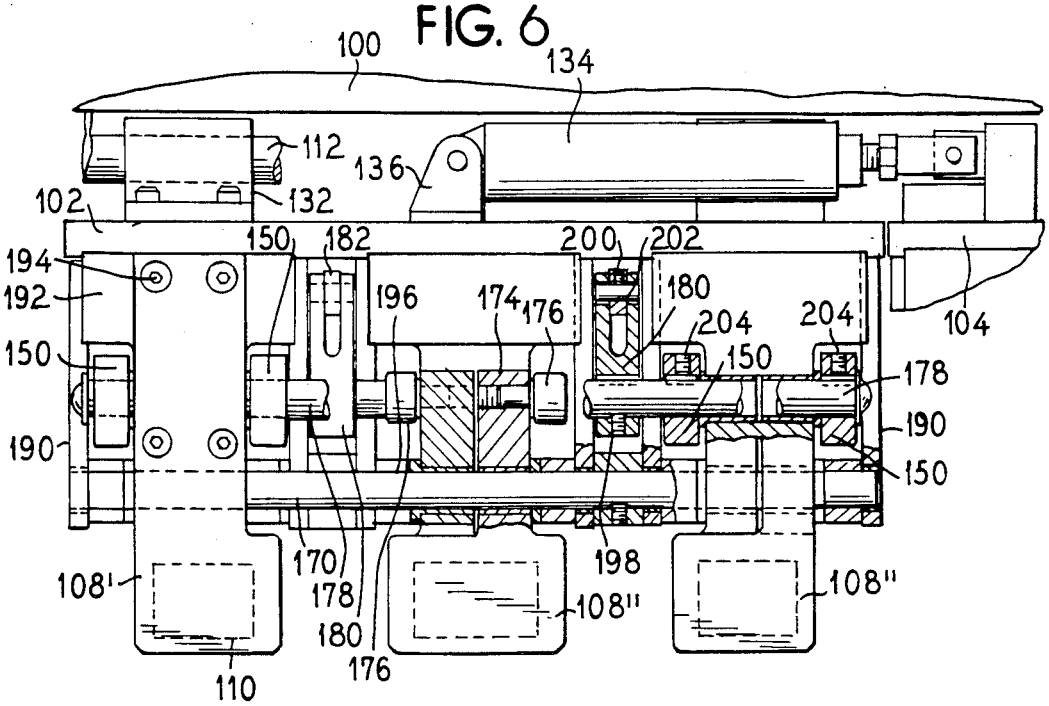

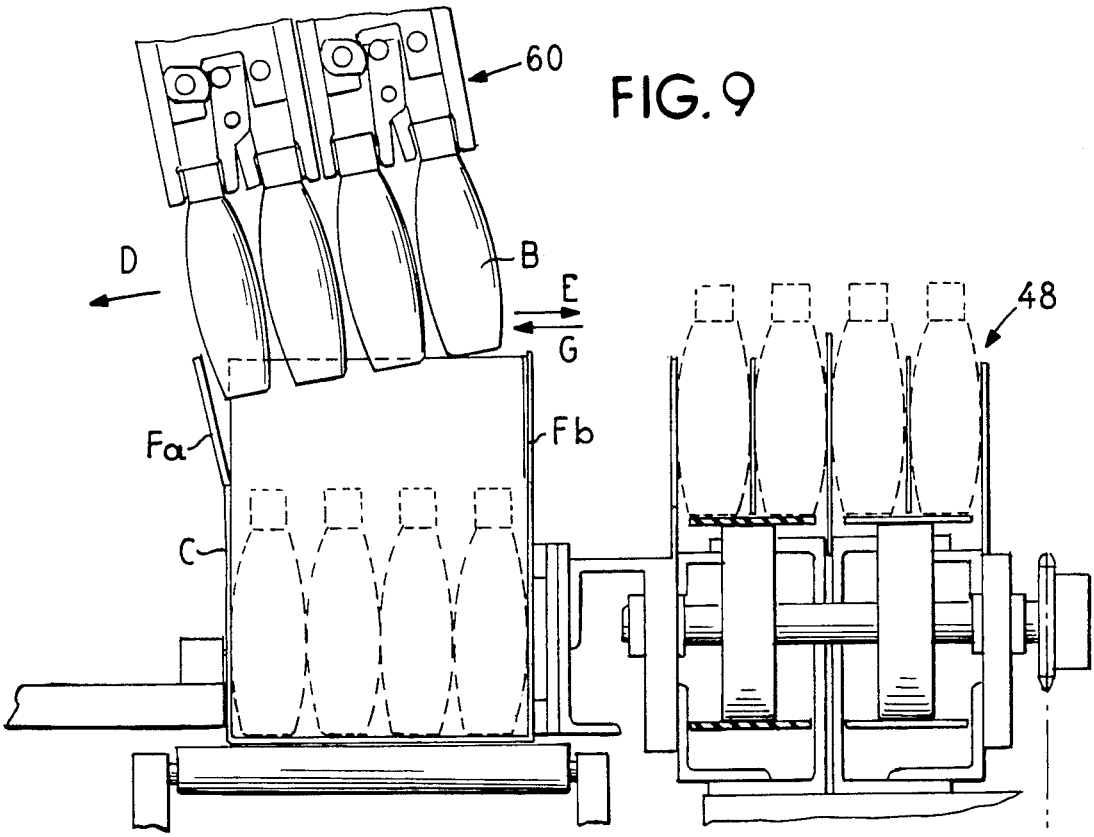
FIG. 9
FIG. 10
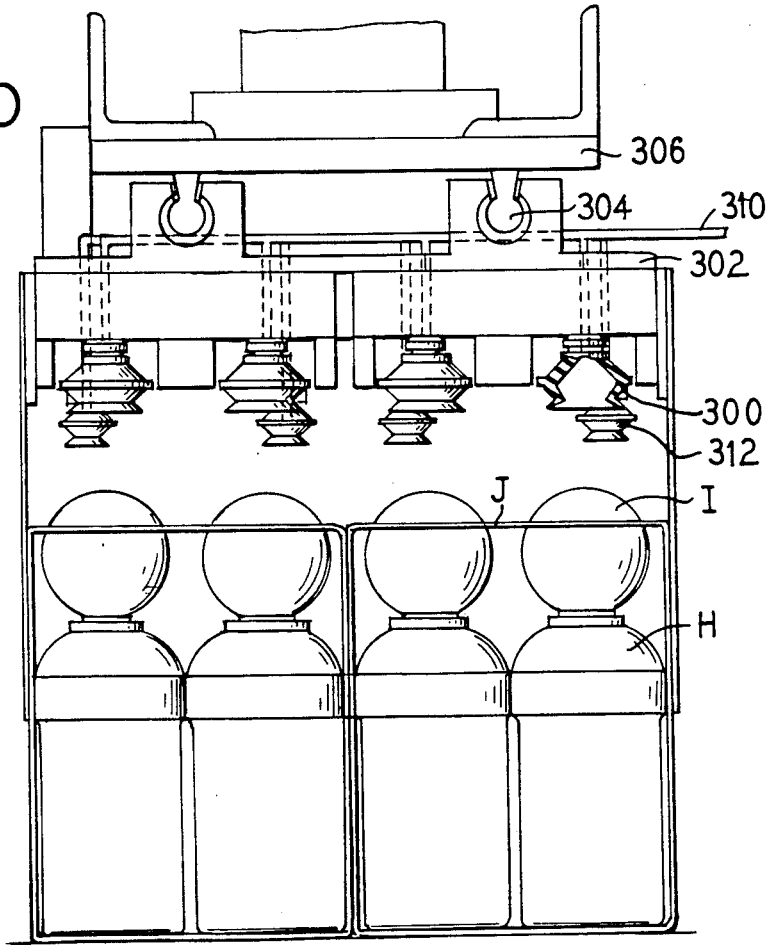

ROBOTIC CASE PACKING SYSTEM AND METHOD

BACKGROUND OF THE INVENTION

1. Field of the Invention

The present invention relates generally to an automated system and method for handling and packing articles into cases and, in particular, for arranging articles into groups and then engaging and lifting the articles and placing the engaged articles into packing cases.

2. Description of the Related Art

Automated article handling systems are generally known, including article handling systems for packaging articles both individually and together in groups. Also known are various end effectors for robotic arms for use in manufacturing or article handling settings. Many of the known end effectors engage a single article at a time. The robotic arms on which these end effectors are mounted are identified by the number of axes of movement through which the end effector may be moved. For example, five axis robotic arms are known.

SUMMARY OF THE INVENTION

An object of the present invention is to fill a plurality of cases simultaneously with a plurality of articles in each case.

Another object of the invention is to simultaneously and individually grasp a plurality of articles and thereby hold the articles in known positions for handling, transportation and packing of the articles into cases.

A further object of the invention is to provide an easily changeable automated case packing system which can be changed to accommodate different shaped articles and different sizes and capacities of cases having different numbers and arrangements of the articles in the cases.

Yet another object of the invention is to provide error-free handling and insertion of plural articles into plural cases and, in this regard, to arrange the articles into groups corresponding to the arrangements to be packed into the cases, to gather the articles together prior to being engaged, to effectively engage each individual article for lifting and transporting, to secure and square the cases during packing, to move the top flaps of the cases into an open position during insertion of the articles, to separate the articles into a number of groups corresponding to the number of cases being simultaneously packed, and to place the articles into the cases.

Yet a further object of the invention is to pack cases with articles at a rate at least as fast as the rate at which the articles are produced, assembled or finished.

These and other objects and advantages of the present invention are achieved by a system connected in, for example, the production line of an article manufacturing or assembling facility which includes an article conveying means for moving the articles from, for example, the output of the manufacturing or assembling facility, an article arranging and grouping means for arranging the articles into groups for handling by a transporting means, a transporting means for engaging and transporting a predetermined number of articles for packing into at least one, and preferably more than one, case, and a case transporting and securing means for moving empty cases into a loading position, securing the cases in the loading position, and moving the filled cases out of the loading position. Each of the foregoing means are automated and under the control of a control means, which coordinates the operation of the various means for the automated packaging of the articles.

The article conveying means, in an exemplary embodiment, is a conveyor having a lane for transporting the articles serially along a line in single file. The rate at which the articles move along the conveyor is, preferably, determined by the rate at which the articles leave a manufacturing or assembly line. For purposes of discussion in an exemplary embodiment, the articles are plastic bottles of, for example, shampoo, lotion, or the like which are being output in single file from a bottle filling and capping apparatus, for example.

The article arranging and grouping means for arranging the articles into groups for handling includes, for example, diverters which channel the articles into parallel rows or lanes. The diverters preferably are flaps or movable partitions which alternately feed the single file flow of the articles into parallel lanes. For example, a first diverter channels the articles into two parallel rows. Additional diverters may be provided to arrange the articles into further rows, as needed. Each diverter is associated with a stop gate to periodically interrupt the flow of articles as the diverter changes position.

A counter is provided along the flow path of the articles, such as where the articles are divided into the two parallel rows, to count the articles and thereby permit control of the number of articles fed to the further stages of the device. Since the exemplary embodiment of the device is used for packaging of plastic bottles, which are flexible and tend to rebound when stopped abruptly, the counter and the associated stop gate are set to accommodate the flexing and bouncing of the bottles, such as by the use of a time delay, as the bottles are moved and then stopped in the flow path.

A second diverter stage in the exemplary embodiment channels the double rows of articles into four parallel rows using a pair of flaps or movable partitions. Once fed into the four parallel rows, a final stop gate, which is preferably a self-locking stop gate in case of system or power failure, holds the articles in a prepickup stage at the appropriate time, the stop gate opens to release all four parallel rows, each of which has a desired number of articles, into the pickup area. The number of rows into which the articles are diverted and the number of articles in each row is, of course, dependent on the arrangement that the articles are to be in once in the packing case. Thus, the present invention encompasses systems for diverting and arranging the articles into other numbers of rows, as well.

At the same time that the articles are being arranged and grouped by the article arranging and grouping means, a case transporting and securing means is moving empty cases along a conveyor into a loading position. A pair of stop gates on the case transporting and securing means feeds a predetermined number of the cases into the loading position. It has been found that the cases, such as cardboard boxes, are frequently nonsquare and may be distorted somewhat, particularly when new. Therefore, once the cases have reached the loading position, a case securing and squaring means is activated to square the cases and hold them in a predetermined loading position. In particular, squaring panels are pressed against the sides of the cases to insure proper alignment of the empty cases during the loading operation. Once filled, a filled case moving means, which is preferably the same conveyor that moved the cases into the loading position, quickly moves the filled cases out of the loading position for fastening closed so that the next batch of empty cases to be filled may be moved into the loading position for squaring and filling.

A significant feature of the present invention provides an article transporting, or transferring, means for engaging the articles which are in the pickup area and transporting the articles from the pickup area into the cases in the loading position. The present transporting means includes a robotic arm on the end of which is mounted an end effector, or head. The robotic arm is preferably a five axes robot arm for moving the end effector through five axes, or degrees, of freedom.

The end effector of an exemplary embodiment includes a body generally defining a plane upon which are mounted a plurality of gripper elements for gripping the articles in the pickup area. The gripper elements are arranged in parallel rows in line with the flow direction of the article arranging and grouping means which supplies the articles. Preferably, the number of gripper elements corresponds to the number of articles which have been guided into the pickup area by the article arranging and grouping means, and the gripper elements are constructed and operated such that each article is individually engaged by one pair of the gripper elements.

An exemplary embodiment of the gripper elements has a first row of gripper elements stationarily mounted on the body, and each of the stationarily mounted gripper elements have a gripping surface directed in a first direction generally perpendicular to the plane of the body. A second row of the gripping elements are mounted on the body in such a way as to pivot about an axis. Each of the gripping elements in the second row have gripping surfaces facing in a second direction generally opposed to the gripping surfaces of the gripping elements in the first row.

A third row of gripping elements is mounted on the body adjacent the second row for pivoting movement about an axis. The pivot axis of the third row of gripping elements is preferably the same as the pivot axis of the second row. Each of the gripping elements in the third row have gripping surfaces directed generally in the same direction as the gripping surfaces of the gripping elements in the first row. A fourth row of gripping elements is stationarily mounted on the body adjacent to the third row. Each of the gripping elements in the fourth row have gripping surfaces directed generally in the second direction and opposing the gripping surfaces of the gripping elements in the third row. This forms a two-row gripping unit for gripping two parallel rows of the articles.

The gripping surfaces of the gripping elements are each provided with pads of elastomeric material. The elastomeric material compresses during the gripping action of the gripping elements to ensure that each of the articles is gripped securely.

As many of the two-row gripping units may be arranged on the body of the end effector as needed to grip the appropriate number of articles for packing into the boxes. For example, for gripping four parallel rows of the articles, as in an exemplary embodiment, a second gripping unit with four rows of opposed gripping elements is mounted on the head adjacent to, and preferably parallel to, the first four row unit. The number of gripper pairs in each row of the gripping units may vary, but in a preferred embodiment the number of gripper pairs per row equals the number of articles per row to be packed into each box.

Each of the pivoting grippers in the gripping units are abutted by a corresponding number of cams mounted on the body, which in turn are rotated by cam actuating cylinders via levers. One cam actuating cylinder is provided for each of the gripping units such that independent gripping forces are applied on the articles by each of the gripping units to insure that each article in the arrangement of articles being packaged is gripped independently and securely.

Although the present end effector may be used for packing a single case at one time, it is preferred that the end effector be adapted for simultaneously packing a number of the cases with the articles simultaneously. To this end, the grippers on the end effector, or body, are arranged on a number of head portions which are movable relative to one another, the number of head portions generally corresponding to the number of boxes to be packed simultaneously. Each of the head portions is made up of, in the exemplary embodiment, two of the gripping units arranged laterally of one another. Of course, depending on the number of articles to be packed into each box, it is also possible to arrange the gripping units end-to-end in a single head portion or to provide more than two of the gripping units side-by-side in each head portion.

To permit movement of the head portions relative to one another, in particular, certain ones of the head portions are slidable along the body to separate the engaged articles into groups corresponding to the number of articles destined for each case. The separation distance between the adjacent heads is sufficient to span the adjacent edges of the adjoining boxes or cases. The sliding movement of the head portions toward and away from one another is made possible by the head portions being mounted on guide rails which are provided on the body, and certain ones of the head portions are slidable along the guide rails. Also included are actuators connected to the certain head portions for moving the certain head portions along the guide rails. In an exemplary embodiment, the actuators are mounted extending between adjacent head portions so that each separation of the head portions is accomplished by one head portion in effect "pushing off" the adjacent head portion.

The end effector of the present device is controlled in synchronism with the control of the robotic arm to which it is attached so that the arrangement of the articles in the pickup area is gripped, lifted, transferred to the loading area and then inserted into the boxes. For gripping, the gripper elements are moved to their open position and the head portions are moved together. The end effector, or head, is then moved toward the arrangement of the articles in the pickup area from a lateral direction and tilted at an angle to horizontal in such a way that the articles are gathered toward one another laterally by first engaging the edge-most row of the articles and pushing the edge-most row toward the other rows of articles.

The head is rotated about an axis parallel to the rows of articles as the head is moved laterally so that all of the articles in the arrangement are gathered together and brought into position for engagement by the gripper elements with portions of the articles disposed between the opposing gripper elements. The gripper elements which are pivotable then are pivoted so that the articles are engaged between the pairs of gripper elements. Since each pair of gripper elements grips the articles somewhat independently, each of the articles is gripped by a gripping force that ensures engagement of that article and thereby accommodates slight variations in the sizes or orientations of the articles.

Once securely engaged, the end effector head containing the arrangement of articles is lifted from the pickup area and moved toward the waiting row of boxes in the loading area. While the boxes have been temporarily secured in position and squared by the securing and squaring means, the flaps of the boxes still extend upwardly and tend to interfere with the insertion of material into the boxes. To overcome this problem, the end effector, or head, is moved in such a way as to move the flaps to an open position.

In particular, the end effector is tilted about an axis generally perpendicular to the direction of movement of the end effector toward the boxes and is moved at an angle downwardly toward the far-side flaps of the boxes. The articles in the edge-most row engaged in the head contact and push the far-side flaps to an open position. The head is returned to a horizontal position and moved back toward the near side of the row of boxes so that the articles contact the near-side flaps and move the flaps to an open position. The head is then centered over the open boxes and moved vertically in a downward direction to place the appropriate number of articles into each corresponding box. The grippers release the articles within the boxes, and the end effector returns to pick up the next grouping of articles in the pickup area.

Thus, the robotic arm and the end effector are controlled to cause the end effector, or head, to move through a modified Z-pattern to open the box flaps and insert the articles into the boxes. To accommodate the flaps on the adjoining walls of the boxes, the head portions are moved far enough apart to clear the flaps, as described above.

The present end effector may be easily reconfigured to engage different numbers and arrangements of articles and to place different numbers and arrangements of the articles into different numbers of boxes or cases. This can be accomplished, for example, by mounting a different number of the gripper units together on each head portion, or by mounting a different number of head portions together on a end effector or head. It is also contemplated that the gripper units may be changed for gripper units of different sizes or types or having a different number of gripper pairs in each unit. In addition, the entire end effector is also easily changeable from the robotic arm for another end effector. Changing of the entire end effector may be preferred when each is set up for a particular type or size of article. The construction of the present device can, thus, be described as modular.

As part of the automatic control of the present device, various sensors and counters are provided to count the articles moving into the pickup area, to count the number of boxes moving into the loading area and to sense, for example, presence of the articles in the pickup area, the presence of the boxes in the loading area and the engagement of the articles by the grippers. Sensors that are mounted on the head or end effector may be in a position to be knocked or otherwise interfered with as the device operates. Therefore, in one embodiment, a shield is mounted on the head to divert the box flaps away from the sensors as the cases are being loaded.

An alternate gripper means may be provided according to the present invention. Instead of the stationary and pivoting grippers, an alternate embodiment of the present end effector has suction type surfaces for engaging the top surfaces of the articles for use with articles that are smooth on the top surface. The suction cup type grippers are pneumatically operated to generate a partial vacuum when engaged on the top surfaces of the articles to thereby hold the articles during transporting and packaging. The pneumatic operation of the suction type grippers permits easy disengagement of the articles from the grippers as well, simply by release of the partial vacuum. As with the foregoing pivoting grippers, the suction cup type grippers are also arranged in gripper units and head portions corresponding to the capacities of the cases to be packed.

Each element in the foregoing system is connected to either a single control means or to a plurality of coordinated control means for coordinating the movements of the conveyors, the stops, the robotic arm and the end effector to provide fast, accurate and error free loading of the articles into the boxes. The control means is preferably a computer based electronic control, with appropriate software for the particular environment and arrangement of articles to be handled, or includes logic circuits to control the operation and movements of the various portions of the present robotic case packing system.

BRIEF DESCRIPTION OF THE DRAWINGS

FIG. 5 is an enlarged cross section generally in the direction of FIG. 4 showing operational details of the end effector and grippers;

FIG. 6 is an enlarged side view of a portion of the end effector of FIG. 5;

FIG. 9 is an end view of the present end effector prepared to insert a plurality of articles into a case, including the articles shown in phantom in the pick-up region and in the final packaged position in the case; and FIG. 10 is an end view of an alternate embodiment of the end effector according to the principles of the present invention.

DESCRIPTION OF THE PREFERRED EMBODIMENTS

Figure 1:
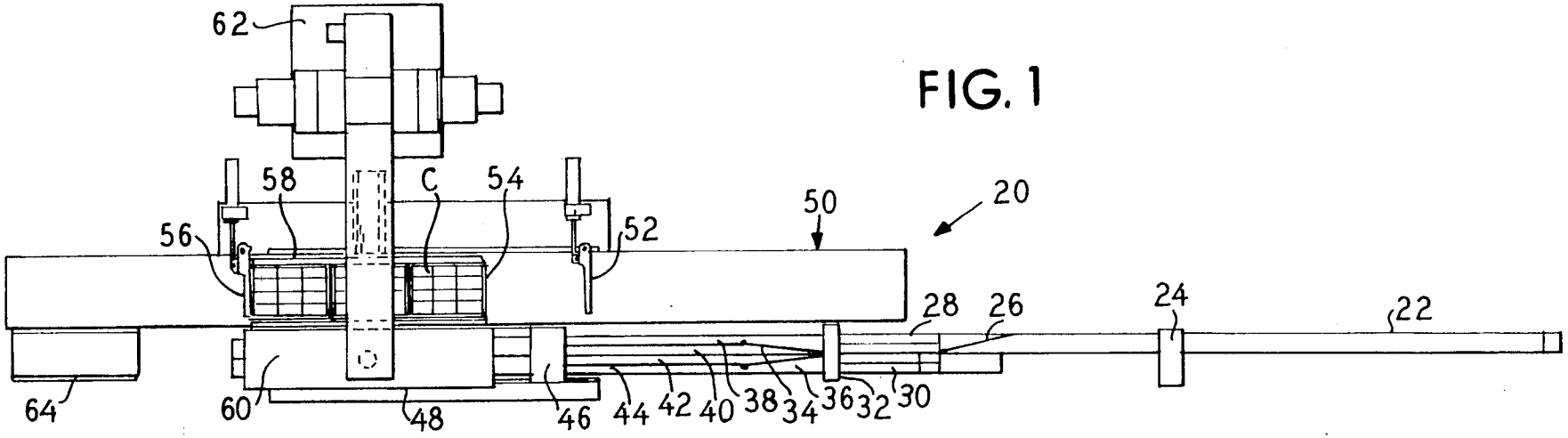
FIG. 1 is a top plan view of the present robotic case packing system showing an exemplary embodiment of the apparatus according to the principles of the present invention.

In FIG. 1 is shown a plan view of an exemplary embodiment of the present robotic case packing system 20 for automatically packing articles into cases. Articles to be packed move along the system from right to left with respect to FIG. 1, entering the system 20 in single file on a conveyor 22. The articles may be of any type and may enter the conveyor 22 from any of a variety of sources.

For example, the illustrated, or exemplary, embodiment will be described for packing a plurality of individual bottles, or articles, B into shipping cases, or boxes, C, the individual bottles B entering the conveyor 22 from an output of a bottle filling and capping apparatus (not shown).

The bottles, or articles, B move in single file along the conveyor 22 to a first stop gate 24 where the moving row of articles B is selectively, alternately stopped and released. Following the stop gate 24 is a diverter 26 in the form of a flap or gate which directs the single file row of the articles B alternately into two parallel rows onto conveyor portions 28 and 30. First the stop gate 24 is activated to interrupt the flow of articles B along the conveyor, although the conveyor continues to operate, and then the diverter 26 is pivoted to a position as shown in FIG. 1. Upon release of the stop gate 24, the articles B move into the conveyor portion 30. A counter for counting the articles B as the articles move past a sensor is associated with the stop gate 24 so that the stop gate 24 can be controlled to a closed position to again interrupt the flow of articles B after a predetermined number of the articles B has moved past the sensor. The counter may include an optical sensor, a tactile sensor, or some other type of detector for determining the number of articles moving along the conveyor 22. The counter preferably operates with a time delay so that rebounding of the articles as the stop gates operate do not adversely effect the count of the articles.

After the article flow is interrupted by the closing of the stop gate 24, the diverter 26 is pivoted to the second position to direct the subsequent flow of articles B into the conveyor portion 28. The stop gate 24 is opened and the flow of the articles B permitted to resume. After the predetermined number of articles has again passed the stop gate 24, the stop gate is once again closed. Equal numbers of the articles B are now aligned in the two conveyor portions 28 and 30. This forms two parallel rows of the articles or bottles B, each with a predetermined number of the articles.

As the articles or bottles B enter the conveyor portions 28 and 30, a second stop gate 32 alternately and selectively interrupts and releases the flow of articles. The stop gate 32 is kept closed until both rows of the articles in the conveyor portions 28 and 30 have the predetermined number of articles. Both rows of the articles B are released simultaneously by the opening of the second stop gate 32 and are fed to a pair of second stage diverter gates 34 and 36 to direct the parallel flow of the two article rows alternately into four parallel conveyor rows. The operation of the diverter gates 34 and 36 along with the alternate interruption and release of the flow of articles aligns the articles B into four parallel rows in the conveyor rows 38, 40, 42, and 44. The four conveyor rows 38–44 of the illustrated embodiment are on two conveyor belts, as will be described. The conveyor rows 38–44 are referred to as a staging area for the pickup area of the case packing mechanism.

The rows of articles B are held in the staging area by a third stop gate 46 before being released into a pickup area 48. At least the gate 46, and possibly the stop gates 24 and 32, are self-locking gates to prevent jamming of the articles B in case of system failure or power failure. The gates 24, 32, and 46 are, in a preferred embodiment, pneumatically actuated.

Extending adjacent to at least a portion of the article conveyor system 22 is a case handling conveyor 50 along which moves cases, or boxes, C to be filled by the present case packing apparatus. In the illustrated embodiment, the cases C move from right to left relative to FIG. 1. A case stop 52 periodically interrupts the movement of the cases and selectively permits a predetermined number of the cases to pass into a case loading zone 54. Once a predetermined number of the boxes C is in the case loading zone 54, a second case stop 56 holds the cases in position for packing. To establish a predetermined exactly defined position for the empty cases C and to insure that the cases C are square, a box squaring mechanism 58 in the form of plates or bars presses against the sides of the empty cases to square and hold the cases C while being loaded. Once loaded, the conveyor 50 moves the boxes away from the case packing system, to the left with respect to FIG. 1, by opening the stop 56 and the box squaring mechanism 58.

The rows of articles or bottles B are transported from the pickup area 48 to the loading zone 54 through the use of an end effector 60 on a robotic arm 62. The robotic arm 62 is, in the preferred embodiment, a five-axis robotic arm. The end effector 60 grips the articles B, lifts them and places them into the empty cases, as will be described hereinafter.

A master control panel 64 is provided at a convenient location, the control panel including control switches and the like for the various control circuits, such as programmable control circuits for coordinating the movement of the conveyors, the stops, the robotic arm, and the end effector to provide fast, accurate, and error free loading of the articles B into the cases. Preferably, the control circuitry is contained in the housing for the control panel 64, although this need not always be the case.

Figure 2:
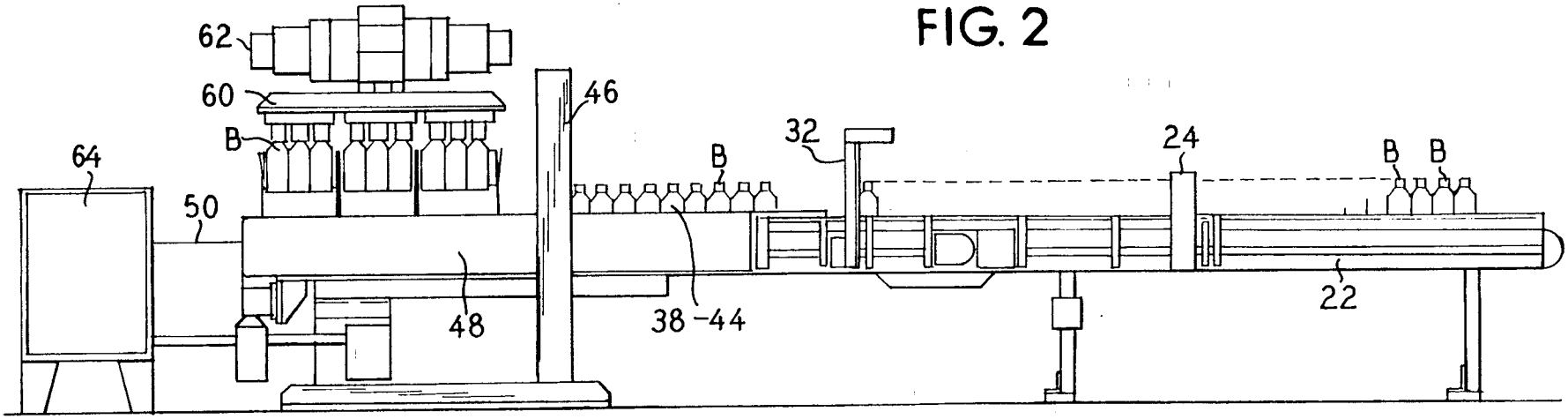
FIG. 2 is a side elevational view of the robotic case packing system of FIG. 1.

In FIG. 2, the articles or bottles B can be seen on the conveyor 22 for movement in a leftwardly direction relative to the figure until the bottles reach the staging area 38–44 before being forwarded to the pickup area 48. In the staging area 38–44, the articles B correspond in number and arrangement to the number and arrangement to the articles which have been placed into the cases C by the end effector 60.

In the example shown in FIG. 2; three cases are being packed simultaneously be the end effector 60, where each case is packed with an arrangement of the articles B which is three articles wide and four articles deep. The movement of the articles along the conveyor 22, the operation of the stop gates 24, 32 and 46, the operation of the case handling conveyor 50 with the associated case stop 52 and box squaring mechanism 58 as well as the end effector 60 and the robotic arm 62 are all controlled through circuitry and programs in the master control unit 64.

Figure 3:
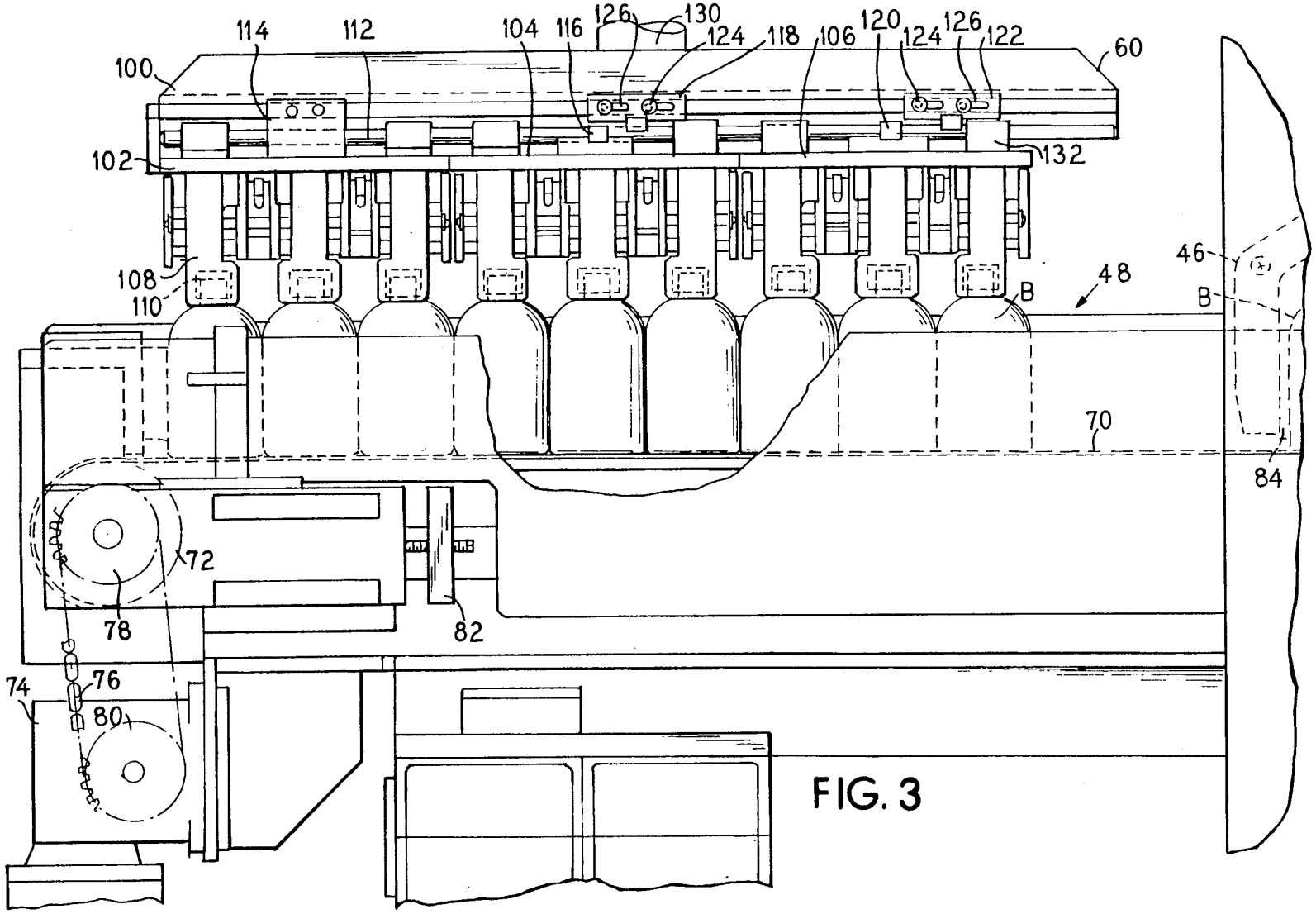
FIG. 3 is an enlarged fragmentary side view of the conveyor and end effector of the system shown in FIG. 3.

In FIG. 3 is shown an enlarged front view of the case packing system 20 in the region of the pickup area 48. The conveyor 22 includes a belt 70 for carrying the articles B, the belt 70 being moved through a drive roller 72 which in turn is driven by a belt drive motor 74 acting through a power transmission chain 76 and a pair of drive gears 78 and 80. Adjustment of the tension of the belt 70 is possible through a belt adjusting mechanism 82.

Although the belt 70 is driven continuously, the flow of the articles B is periodically interrupted by the third stop gate 46, shown in phantom. The stop gate 46 includes a stop arm mounted for pivoting about a horizontal axis and provided with an abutment plate 84 for selectively abutting the articles B to inhibit their for ward progress. When the appropriate number of the articles B is in the staging area and the pickup area 48 is free of articles, the stop gate 46 is opened to permit the articles B to move into the pickup area 48, as shown in FIG. 3.

Once in the pickup area 48, the articles B are engaged by the end effector 60. In particular, the end effector includes a planar body 100 on which is mounted three head portions 102, 104 and 106. The head portions 102 through 106 are provided with gripper elements 108 arranged in rows and columns for gripping the articles B. The grippers are mounted in pairs and include opposed gripping surfaces 110, as indicated in dotted outline in FIG. 3.

Rails 112 mounted on the body 100 slidably mount the head portions 102, 104 and 106 for sliding movement relative to one another. The sliding movement of the head portions relative to one another permits the articles B to be separated into groups corresponding in size to the capacity of the packing cases C. As can be seen, the first head portion 102 is affixed to the planar body 100 by a head fixing bracket 114 to inhibit the first head portion from sliding along the rails. The head portions 104 and 106 are free to slide along the guide rails 112, however, at least to a limited extent.

The second head portion 104 is provided with a fixed stop member 116 which contacts an adjustable stop member 118 on the body 100 to prevent sliding movement of the second head portion 104 past a predetermined location. Similarly, a fixed stop member 120 is provided on the third head portion 106 for selective abutment against a corresponding adjustable stop member 122 on the head 100 to prevent movement of the third head portion beyond a second predetermined position. The adjustable stop members 118 and 122 are each connected to the head 100 by pairs of bolts 124 extending through slots 126 in the adjustable stop members. It is thereby possible to adjust the position of the adjustable stop members 118 and 122 in an axial direction relative to the guide rail 112 as needed.

The three head portions 102, 104, and 106 are shown in FIG. 3 positioned abutting one another. In this position, the gripper pairs in the head portions are spaced from one another approximately equal to the spacing of the caps or other gripping surfaces of the articles, or bottles, B. After the articles B are engaged and lifted, the head portions 102, 104 and 106 are separated from one another by sliding along the rails 112 until the fixed stop members 116 and 120 contact the adjustable stop members 118 and 122. When separated from one another to the fullest extent, the spacing between adjacent head portions is at least as great at the thickness of the adjoining sides of the boxes C into which the articles are to be place. Of course, the provision of additional mounting holes for the bolts 124 permits further adjustment of the location of the adjustable stop members to accommodate different thicknesses of boxes and different sizes of boxes.

Figure 4:
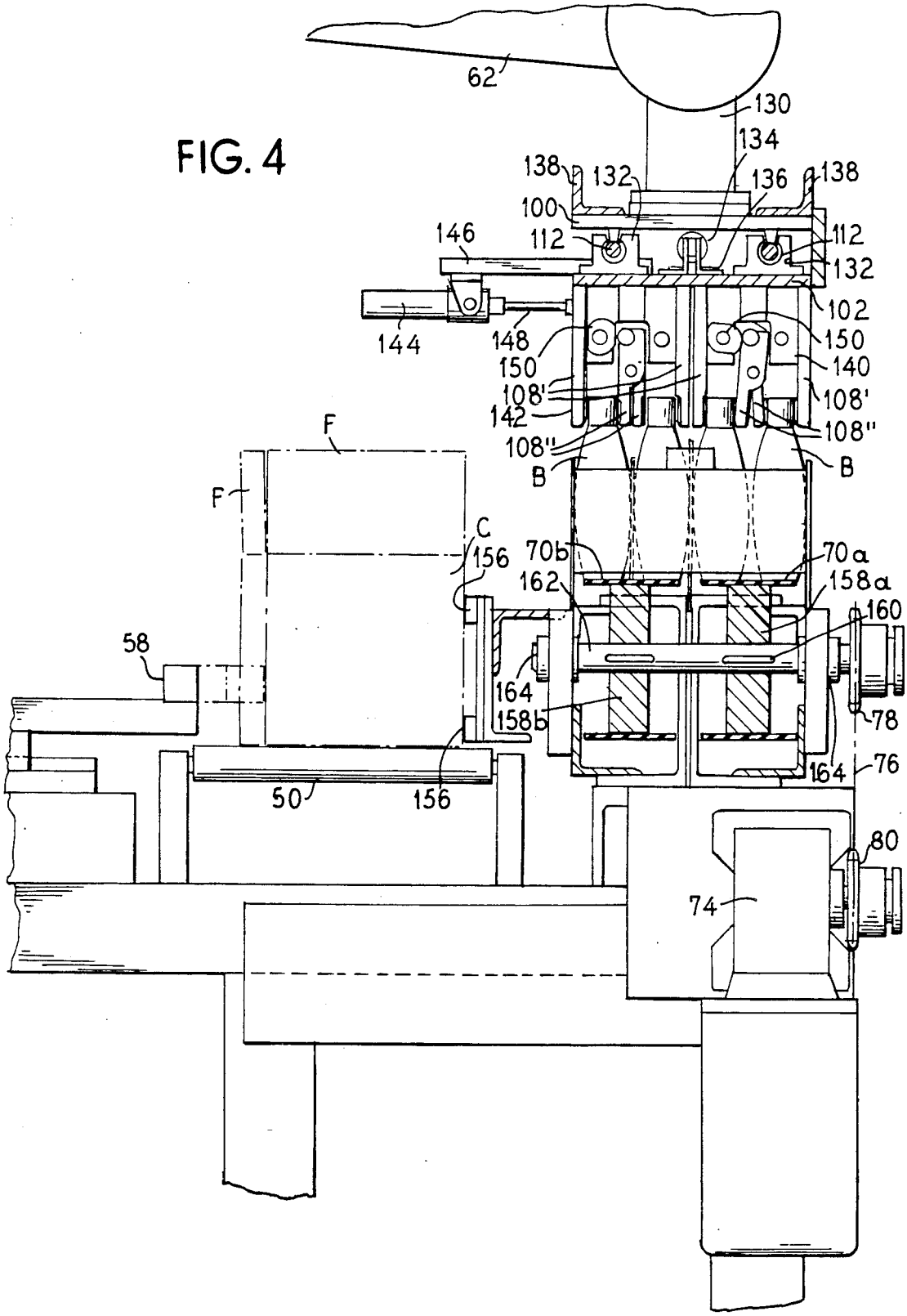
FIG. 4 is an end view of the article transfer station of FIGS. 1 and 2 taken generally from the left with respect to FIGS. 1 and 2.

In the end view of FIG. 4, the robotic arm 62 is shown mounted to the planar body 100 by a wrist mounting 130. On the planar body 100 is two of the guide rails 112. Rail bearings 132 at least partially encircle the cylindrical guide rails 112 and slidably support the head portions 102, 104 and 106. For movement of the head portions 102, 104 and 106 relative to one another, a cylinder such as a hydraulic cylinder 134 is mounted on a bracket 136. The cylinder 134 extends between adjacent head portions, as will be described hereinafter, so that sliding forces are between the head portions. Angle irons 138 mounted on the top surface of the body along either side thereof provide additional support for the planar body 100.

Two types of the gripper elements 108 are provided; namely, stationary gripper elements 108' and movable, or pivotable, gripper elements 108''. Both types of gripper elements are provided in each of the gripping units 140 and 142, two of the gripping units being shown side-by-side in FIG. 4. Each of the illustrated gripping units 140 and 142 includes a pair of outer rows of stationary gripper elements 108' and a pair of inner rows of pivotable gripper elements 108'' arranged between the outer rows.

The movable gripper elements 108'' are pivoted by gripper actuating cylinders 144 mounted on actuator brackets 146. Two of the actuating cylinders 144 is provided for each head portion, and the preferred actuating cylinders are pneumatic. Each of the cylinders 144 has an actuator rod 148 that is moved by the operation of the actuator 144 and is connected in the end effector head in such a way as to rotate cams 150.

For purposes of illustration only, the gripping unit 140 has the movable gripper elements 108'' shown in the closed position engaging the articles B, while the gripping unit 142 has the movable gripper elements 108'' shown in the open position. Preferably, the movable gripper elements of the end effector are operated in synchronization with all elements opening and closing at approximately the same time.

Also shown in FIG. 4 is the box squaring mechanism 58 shown in solid outline in a position for accepting the cases into the case loading zone 54 and shown in phantom in a position for squaring the cases C. When in the squaring position, the mechanism 58 presses the cases C against wall portions 156 as the cases rest on the case conveyor 50. At the same time, the boxes C are being pressed against the stop gate 56. This assures that the sides of the boxes C are square as the articles are being inserted.

In FIG. 4, the flaps F of the cases C are shown in their normal, open position. However, various cases or boxes C will have the flaps F in different positions and some may bend over the open top of the box more than others. In any event, the flaps F must be moved to a position that does not interfere with the movement of the end effector as the articles are inserted into the cases. As will be described, the present apparatus is operated to move the flaps F to a more open position for insertion of the articles into the boxes C.

The conveyor belt 70 is in two parts or belts **70*a* and 70*b* running parallel to one another. The conveyor belt portion 70*a* carries two of the rows of articles B, while the other conveyor belt portion 70*b* carries the other two rows of articles B. The conveyors 70*a* and 70*b* are driven by drive pulleys or rollers 158*a* and 158*b*, which are fixed by keys 160 to a conveyor drive shaft 162. The drive shaft 162 is mounted in journals 164 and is driven through the power transmission chain 76 by the motor 74, as described in conjunction with FIG. 3**.

Referring to FIG. 5, the movable gripping elements 108'' are shown mounted on pivot pins 170 disposed intermediate an article engaging end 172 and a cam follower end 174 on which is mounted a cam follower 176. The article engaging end 172 is provided with the gripping surface 110, which is the preferred embodiment is a pad of elastomeric material affixed in a recess in the end of each of the gripper elements. The cam follower 176 is in the form of a roller which engages the face of a corresponding eccentric cam 150. The cams 150 are mounted on cam shafts 178.

Each of the cam shafts 178 is rotated by a lever 180 which is keyed to the cam shaft 178 at one end and is pivotably connected to a linkage 182 at an opposite end. The linkage 182, in turn, is connected by a pivot connection 184 to the actuator rod 148 of the actuator cylinder 144. The linkage 182 for the left-most gripping unit is shown in solid outline in FIG. 5, while the longer linkage for the right-most gripping unit is shown in phantom. The linkage for the right-most gripping unit is operated by a separate actuating cylinder 144.

Each of the movable gripper elements 108" has a similar construction and is moved through corresponding arrangements of eccentric cams 150, cam followers 176, and levers 180.

As the levers 180 are moved to rotate the eccentric cams 150, the ends thereof connected to the linkage 182 move through arcs. This causes the linkage 182 to undergo not only an axial motion, but also to undergo some vertical motion. To compensate for the vertical component of motion of the linkage 182, the pivot connection 184 is provided between the linkage 182 and the actuating rod 148. In addition, the actuating cylinder 144 is mounted on the bracket 146 by a pivot connection 186.

In FIG. 6, a side view of the head portion 102 of the end effector is partially cut away to reveal the various component parts. In particular, the rail 112 extending from the underside of the planar body 100 supports the head portion 102 by the rail bearings 132 mounted on the top surface of the planar head portion 102. Also mounted on the top surface of the head portion 102 is the bracket 136 for the cylinder 134, the actuator rod of which is connected to the second head portion 104.

Mounted on the underside of the head portion 102 are brackets 190 for the pivot pin 170 about which the moveable gripper elements 108" pivot. The stationary gripper element 108' is affixed to a mounting 192 by bolts 194 and the cam shaft 178 on which the eccentric cams 150 are mounted extends through the mounting 192. The eccentric cams are disposed on either side of the stationary gripper element 108', as shown in the left most set of gripper elements in FIG. 6.

At the middle pair of gripper elements, the stationary gripper element 108' of the outer row is removed and the moveable gripper elements 108" are shown partially cut away to reveal the cam follower rollers 176 mounted by bolts extending into the top ends 174 of the moveable gripper elements 108". Sleeves 196 about the pivot pin 170 permit the moveable gripper elements 108" to pivot on the pivot pin 170. The lower end of the moveable gripper elements 108" are offset and the gripping surfaces 110 thereof overlap to ensure that each opposes a gripping face of a stationary gripper element.

In the right-most gripper elements of FIG. 6, the lever 180 is cut away to reveal a set screw 198 extending into the cam shaft 178 while a second set screw 200 extends through the linkage 182 into a pivot pin 202 connecting the linkage 182 to the lever 180. The eccentric cams 150 are mounted on the cam shaft 178 and held in non-rotatable position thereon by set screws 204.

Figure 7:
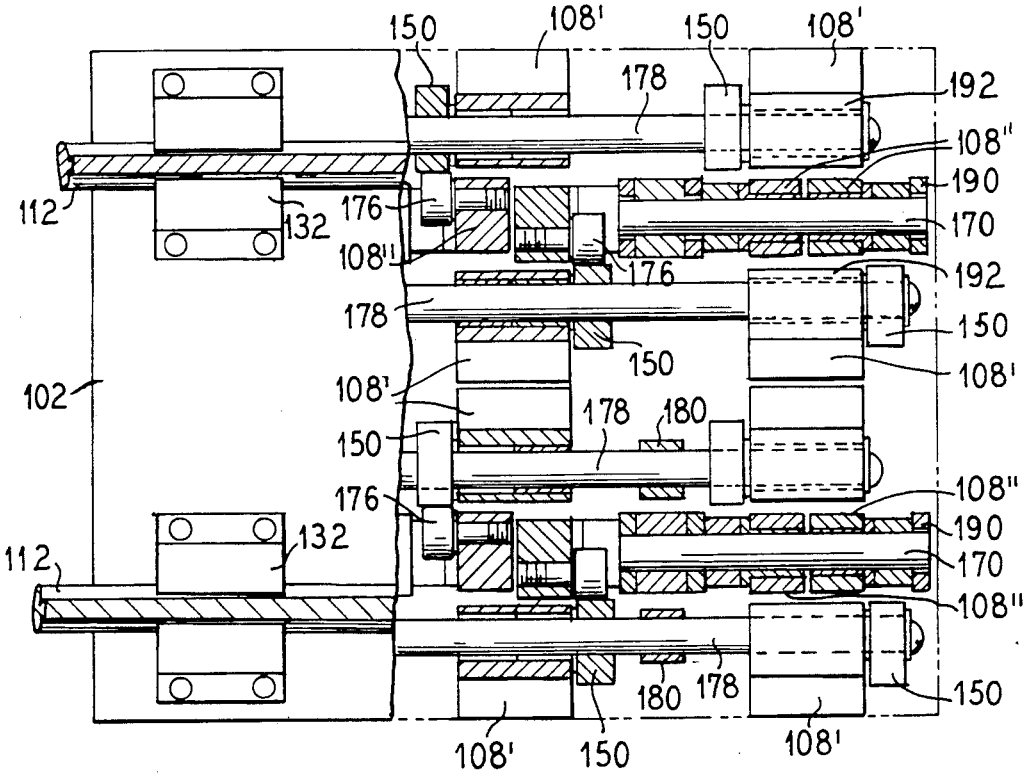
FIG. 7 is a top plan view, partially broken away, of a head portion of the end effector of FIGS. 5 and 6, showing additional details thereof.

In FIG. 7, two pairs of the guide rails 112 carry the head portion 102 by the rail bearings 132. The offset arrangement of the eccentric cams 150, with the cams 150 of the uppermost cam shaft 178 being to a left side of the stationary gripping elements 108' and the eccentric cams 150 being on the right side of the adjacent row of stationary gripping elements 108' can be seen in FIG. 7. This permits compact construction of a head mechanism and equal distribution of the forces. The portions of the moveable gripper elements 108" mounted on the pivot pin 170 are mounted in an axial direction relative to one another along the pivot pin while, as shown in FIG. 6, the gripping surfaces thereof oppose one another in a direction transverse of the axis of the pivot pin 170.

The upper portion of FIG. 7 shows a first gripping unit formed by four rows of the gripping elements 108' and 108", while the lower half of FIG. 7 shows a second gripping unit. The cutaway portion reveals the levers 180 connected only to the cam shafts 178 of the lower gripping unit. The levers 180 which connect to the linkage for rotating the camshafts 178 of the upper gripping unit are disposed beneath the section of the head portion 102 which has not been cut away. Two linkages, each with its own actuating cylinder 144 is provided for each head portion, in the preferred embodiment. Thus, each gripping unit has its own actuating cylinder for operating the moveable gripping elements 108" to provide an even distribution of the gripping forces and ensure that the individual articles are each gripped.

Figure 8:
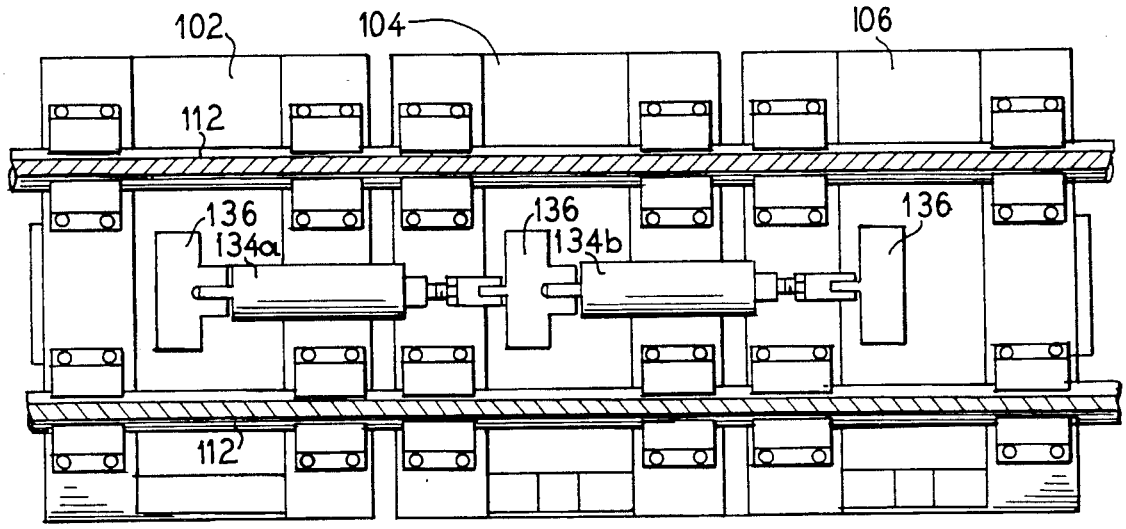
FIG. 8 is a top plan view is of the entire end effector of an exemplary embodiment of the present invention showing three head portions mounted relative to one another.

In FIG. 8, the head portions 102, 104 and 106 are shown from above slidably mounted on the guide rails 112. The spacing between the head portions 102 and 104 is controlled by the cylinder **134*a* while the spacing between the head portions 104 and 106 is controlled by the cylinder 134*b*. By control of the cylinders 134*a* and 134*b*, the head portions 102–106 can be brought together and pushed apart, as needed. The cylinders 134*a* and 134*b*** are pneumatic cylinders.

In FIG. 9, the steps in the loading of the cases C are shown, wherein the articles B shown in phantom in the pickup region 48 have been engaged by the end effector 60, lifted, and moved translationally into the position shown in solid outline. The end effector 60 is tilted and is being moved in the direction of arrow D so that the articles B engage a far-side flap Fa of the case C and push it outwardly to a more opened position. By tilting the end effector 60 and moving it in the direction of arrow D, the lower-most edges of the articles B clear the top of the near-side flap Fb while permitting the articles B to be used to push the far-side flap open.

Once the far-side flap Fa has been pushed to an open position, the end effector 60 is tilted to a generally horizontal position so that the lower most end of the articles B is between the flaps Fa and Fb. The end effector 60 is then moved horizontally in the direction of arrow E to push the inner side flap Fb to an open position and then the end effector 60 is lowered vertically to deposit the articles B into the case C, as shown in dotted outline.

When moving the end effector 60 in the direction of arrow E, the inner-most edge of the case C may be overshot somewhat and then the end effector 60 is moved back in the direction of arrow G. Therefore, the motion of the end effector 60 as the articles B are being deposited into the case C is a modified zig-zag, or Z, motion.

The foregoing exemplary embodiment has been described in conjunction with the packing of cases with 1 individual bottles B that are engaged by the cap mounted thereon by the use of gripping elements. It is, of course, possible to modify the shape, size, number and arrangement of the gripping elements to pack different sizes, shapes, or numbers of articles into cases The generally modular construction of the present apparatus enables easy changeover between end effectors for one product type to an end effector for a different product type or a different case arrangement. However, the gripper design illustrated in the exemplary embodiment is effective at securely engaging and holding individual bottles, or articles, which have various types of caps or tops. For example, the illustrated grippers securely engage not only the common screw-on lid as illustrated, but also securely engage pump-type tops such as frequently provided on hand lotion bottles or liquid soap bottles and the like, non-aerosol spray tops as provided in window cleaners, furniture cleaners and the like, snap-open lids as commonly provided on shampoo bottles and skin lotion bottles, and button-type sprayers as found on cologne bottles and the like. In addition to these examples, many other types of containers, bottles, and articles are easily, accurately and securely engaged, carried and packaged by the present apparatus.

While the present invention finds particular utility in packaging individual articles, it is also contemplated to use the present apparatus to package articles which have been grouped together into, for example, four or six articles in a carton or box and to package several of these grouped articles into a larger case.

An alternate embodiment of an end effector according to the principles of the present invention is illustrated in FIG. 10 in which the articles H to be packed have generally spherical smooth caps I and are already prepackaged in cartons J. In this embodiment, larger suction cups 300 are arranged in a head portion 302, which in turn is mounted on guide rails 304 of an end effector body 306. When lowered onto the smooth spherical caps I, a partial vacuum is applied by vacuum lines 310 to the large suction cups 300 to engage the articles H. The large suction cups 300 are arranged in an arrangement corresponding to the arrangement of the articles H to be packaged.

In addition of the large suction cups 300, smaller suction cups 312 are also provided in the head portion 302 and are likewise connected to the vacuum lines 310. The small suction cups 312 engage the top surfaces of the carton J when the end effector is lowered onto the articles to be packaged. Therefore, not only are the articles H engaged by the end effector of FIG. 10, but also the carton into which the articles H are mounted is engaged by the end effector. Of course, other arrangements of suction cup members may be provided as needed.

Thus, there has been shown and described various embodiments of the present invention in which articles to be packaged are first moved into an arrangement corresponding to the arrangement for packaging, are then engaged by an end effector of a robotic arm, lifted, moved into position over cases to be filled with the articles, moved through a series of motions to ensure that the flaps of the cases are open to accept the articles and then lowered into and disengaged in the cases. Testing of the illustrated apparatus has provided error-free packaging of 36 bottles into three cases at a time each 12 seconds.

Although other modifications and changes may be suggested by those skilled in the art, it is the intention of the inventor to embody within the patent warranted hereon all changes and modifications as reasonably and properly come within the scope of his contribution to the art.

I claim:

1. An apparatus for loading a plurality of articles arranged in side-by-side rows into a container using a robotic arm, comprising:

a gripper head having a planar body;

means for connecting said gripper head to the robotic arm;

a plurality of gripper elements mounted on said gripper head in opposed pairs arranged in parallel rows, each gripper element of said opposed pairs including a gripping face directed toward the gripping face of the gripper element of said opposed pairs, each of said opposed pairs including a stationarily mounted gripper element and a pivotable gripper element wherein said pivotable gripper element is pivotably movable to move said gripping face of said pivotable gripper element alternately toward and away from said gripping face of said stationarily mounted gripper element to individually grip one of the articles therebetween; and means for simultaneously pivoting all of said pivotable gripper elements on said gripper head to simultaneously yet individually grip a plurality of the articles in the side-by-side rows.

2. An apparatus for loading a plurality of articles into a container using a robotic arm, comprising:

a gripper head having a planar body;

means for connecting said gripper head to the robotic arm;

a plurality of gripper elements mounted on said gripper head in opposed pairs arranged in parallel rows, each gripper element of said opposed pairs including a gripping face directed toward the gripping face of the gripper element of said opposed pair, each of said opposed pairs including a stationarily mounted gripper element and a pivotable gripper element wherein said pivotable gripper element is pivotably movable to move said gripping face of said pivotable gripper element alternately toward and away from said gripping face of said stationarily mounted gripper element; and means for pivoting said pivotable gripper elements, said means for pivoting including:

a cam follower mounted on an end of said pivotable gripper elements;

an eccentric cam on a cam shaft mounted with a cam surface abutting said cam follower; and means for controllably rotating said cam shaft.

3. An apparatus as claimed in claim 2, wherein said means for rotating said cam shaft includes:

a lever affixed to said cam shaft and extending radially from said cam shaft to a connecting end;

a linkage connected to said connecting end of said lever; and an actuating cylinder having an actuator rod connected to said linkage so that operation of said actuating cylinder rotates said cam shaft through said linkage and said lever.

4. An apparatus for loading a plurality of articles into a container using a robotic arm, comprising:

a gripper head having a planar body;

means for connecting said gripper head to the robotic arm;

a plurality of gripper elements mounted on said gripper head in opposed pairs arranged in parallel rows, each gripper element of said opposed pairs including a gripping face directed toward the gripping face of the gripper element of said opposed pair, each of said opposed pairs including a stationarily mounted gripper element and a pivotable gripper element wherein said pivotable gripper element is pivotably movable to move said gripping face of said pivotable gripper element alternately toward and away from said gripping face of said stationarily mounted gripper element; and means for pivoting said pivotable gripper elements, a plurality of head portions slidably mounted on said body of said gripper head adjacent one another along an axis, each of said head portions having mounted thereon a plurality of said opposed pairs of said gripper elements; and means for slidably moving one of said head portions relative to others of said head portions along said axis so that groups of said gripper elements are alternately movable toward and away from each other.

5. An apparatus as claimed in claim 4, wherein said means for slidably moving is an actuating cylinder having opposite end connected to adjacent ones of said head portions.

6. A method for loading a plurality of articles from a conveyer into a plurality of boxes, comprising the steps of:

substantially simultaneously engaging a predetermined plurality of articles on a conveyor;

gathering said predetermined plurality of articles toward one another in a first direction, said step of gathering being performed substantially simultaneously with said step of engaging;

lifting said plurality of articles from said conveyor;

positioning a plurality of boxes in a loading position;

tilting said predetermined plurality of articles relative to a plane defined by bottoms of said plurality of boxes;

moving said plurality of articles at an angle to horizontal to engage flaps of said boxes and push said flaps toward an open position;

tilting said predetermined plurality of articles back to the plane defined by bottoms of said plurality of boxes;

centering said plurality of articles over open tops of said boxes;

inserting said predetermined plurality of articles into said plurality of boxes; and releasing said predetermined plurality of articles in said plurality of boxes.

7. A robotic case packing system for transferring groups of individual articles into a case using a robotic arm, comprising:

a conveyer having a means for translating a plurality of articles along a conveying path to a pick-up location;

means for grouping the articles into a predetermined arrangement on said conveyer at said pick-up location;

an end effector mounted on the robotic arm at the pick-up location, said end effector including:

a body defining a plane;

a plurality of gripping elements mounted on said body, said gripping elements being arranged in pairs opposite one another, a first one of each pair of gripping elements being stationarily mounted relative to said body and a second one of each pair of said gripping elements being pivotally mounted on said body;

a plurality of cams mounted on said body and engaging said second ones of each of said pairs of said gripping elements;

means for driving said cams to cause movement of said second gripping elements between a gripping position closer to respective ones of said first gripping elements and a non-gripping position farther from respective ones of said first gripping elements;

a case receiving means for holding a case to be filled at a predetermined location; and a control means for controlling at least said means for grouping and said end effector during packing of the articles into the case.

8. A robotic case packing system as claimed in claim 7, wherein said case receiving means has a capacity for a plurality of cases to be filled, and further comprising:

means on said body for moving ones of said pairs of gripping elements toward and subsequently away from one another in groups to cause said articles held in said end effector to be separated into groups corresponding a capacity of each of the plurality of cases.

9. A robotic case packing system for transferring articles that are arranged in side-by-side rows on a conveyor into plural adjoining cases, comprising:

a robotic arm having plural degrees of freedom;

a generally planar body mounted on said robotic arm;

a plurality of interchangeable heads on said body adjacent one another along an axis, at least one of said interchangeable heads being slidably mounted on said body for alternate sliding movement along said axis toward and away from an adjacent one of said interchangeable heads;

means for sliding said at least one interchangeable head along said axis alternately toward and away from said adjacent one of said interchangeable heads sufficient to span adjacent side walls of the adjoining cases;

a plurality of gripper elements mounted on each of said heads in opposed pairs arranged in parallel rows corresponding to the side-by-side rows of the articles, each gripper element of said opposed pairs including a gripping face directed toward the gripping face of the gripper element of said opposed pair, each of said opposed pairs including a stationarily mounted gripper element and a pivotable gripper element wherein said pivotable gripper element is pivotably movable to move said gripping face of said pivotable gripper element alternately toward and away from said gripping face of said stationarily mounted gripper element to grip the articles in the side-by-side rows therebetween; and means for pivoting said pivotable gripper elements to grip the articles in the side-by-side rows.

* * * * *